United States Patent [19]

Billington et al.

[11] Patent Number: 4,552,065

[45] Date of Patent: Nov. 12, 1985

[54] PRINTING IN REGISTER ON SHEETS

[75] Inventors: Donald G. Billington, Stoke on Trent; Reginald D. Brooker, Stonehouse; Harry Powell, Congleton; Roger Walker, Nantwich; David R. G. Wilkins, Wistaston; Stuart Weaver, Whitchurch, all of England

[73] Assignee: McCorquodale Machine Systems Limited, London, England

[21] Appl. No.: 650,989

[22] Filed: Sep. 17, 1984

Related U.S. Application Data

[63] Continuation of Ser. No. 408,435, Aug. 16, 1982, abandoned.

[30] Foreign Application Priority Data

Aug. 17, 1981 [GB] United Kingdom ..... 8125048
Mar. 3, 1982 [GB] United Kingdom ..... 8206220

[51] Int. Cl.[4] ..... B41J 1/48; B41J 13/26

[52] U.S. Cl. ..... 101/93.33; 101/93.48; 101/233; 101/91; 400/583.3

[58] Field of Search ..... 101/92

[56] References Cited

U.S. PATENT DOCUMENTS

| | | | |
|---|---|---|---|
| 3,049,990 | 8/1962 | Brown et al. | 101/93.34 |
| 3,191,526 | 6/1965 | Ross | 101/233 |
| 3,254,596 | 6/1966 | Shoup et al. | 101/102 |
| 3,343,482 | 9/1967 | Scott et al. | 101/93.20 |
| 3,659,524 | 5/1972 | Beery et al. | 101/235 |
| 3,732,812 | 5/1973 | Bremner | 101/99 |
| 3,734,010 | 5/1973 | Le Gault et al. | 101/79 |
| 3,734,011 | 5/1973 | Williams | 101/235 |
| 3,830,154 | 8/1974 | Hegi et al. | 101/235 |
| 3,908,542 | 9/1975 | Andersson | 400/583.3 |
| 4,033,254 | 7/1977 | Tohey et al. | 101/235 |
| 4,220,084 | 9/1980 | MacLean et al. | 101/235 |
| 4,227,644 | 10/1980 | Sakano | 400/580 |
| 4,334,471 | 6/1982 | Noyer et al. | 101/235 |

FOREIGN PATENT DOCUMENTS

| | | | |
|---|---|---|---|
| 2648870 | 5/1978 | Fed. Rep. of Germany | 400/580 |

*Primary Examiner*—William Pieprz
*Attorney, Agent, or Firm*—Kemon & Estabrook

[57] ABSTRACT

This invention is concerned with the high speed printing of a line of text on a sheet in very accurate registration with an edge of the sheet or another feature (for example an existing print line) on the sheet. The sheet is fed without preregistration on to a track (10, FIG. 1) which passes the printing station (20). A detector (16) adjacent the track senses the arrival of the edge or some other feature of the sheet and a printing control means (14) responsive to the detector signal initiates the firing of the printing hammer (22) when the print line reaches the printing station, a registered operation being thereby effected without stopping the sheet. The detector signal may start the operation of a counter (70, FIG. 4) and a firing signal is sent to the hammer control circuit (100, 102, 104) when the count reaches a value dependent on the distance between the detector and the point at which the printing operation takes place and (unless the new print is to be in alignment with a detected print line) also dependent on the distance on the sheet between the edge or feature detected and the position at which the new print is to appear.

6 Claims, 8 Drawing Figures

PRINTING IN REGISTER ON SHEETS

This application is a continuation of application Ser. No. 408,435, filed Aug. 16, 1982, now abandoned.

This invention is concerned with performing a printing operation on a sheet in accurate register with an edge of the sheet, or with an earlier operation performed on the sheet, for example an earlier printing, slitting, perforating or drilling operation.

In many cases, marks must be printed on a sheet in very accurate register with the edge or earlier operation. An example is the printing of personalising information on individual cheques or sheets of cheques for machine reading. Such personalising information may be printed by more than one printing unit. An individual cheque printed with personalising information will be bound with other cheques to make up a cheque book and a sheet of cheques so printed will subsequently be guillotined, after which the individual cheques from a number of sheets will be formed into individual cheque books. Thereafter, that part of the personalising information which is printed with magnetic ink will be read by a machine and any error in register of the printed information will affect the ability of the machine to make an accurate reading.

Apparatus according to the present invention, for printing on each of a series of sheets so that the resulting printed mark on a sheet is registered with respect to an edge of the sheet or with respect to an operation previously performed on the sheet, comprises: means defining a flow path for the sheets; a printing station located at a predetermined point along the flow path and including type faces and a hammer or hammers to cause impact printing of a sheet against the type faces; and further comprises sheet-feeding means feeding each sheet continuously along the flow path and past the said station; sensing means detecting the arrival of the edge of the sheet, or the arrival of a feature resulting from the said previous operation on the sheet, at a given point along the flow path and providing a corresponding electric signal; and printing control means responsive to the signal from the detecting means to initiate the firing of the printing hammer or hammers when the print line reaches the printing station whereby a registered printing operation is effected without stopping the sheet.

In the preferred apparatus embodying the invention, the sensing means is located upstream of the printing station. In this preferred form, the printing control means comprises timing means controlled in accordance with the distance of the portion of the sheet to be printed from the printing station at the moment of detection, to initiate the firing of the printing hammer or hammers after an interval equal to the time required to advance the sheet through that distance. The interval defined by the timing means takes into account the speed of movement of the sheet feeding means. The timing means may, for example, respond to clock pulses provided by a shaft encoder coupled to a shaft for driving a belt on which the sheet is advanced along the flow line to the printing station.

In the past, when very accurate register was required, it was customary to feed the sheets along a track towards the printing station using a gripper transport system, pinch rollers or a vacuum track, for example. The sheets were fed on to the track in accurate register or were registered immediately after being fed on to the track. Alternatively, the sheets were registered at the printing station by stopping the track or the sheets. In such cases, the apparatus operates in predetermined cycles and the cycle length must be reset each time the size of the sheet is changed and each time the positions of the personalising indicia are changed. Machines for carrying out such operations generally require the stations which perform printing or other operations on the sheet to operate synchronously with one another and with the track, each time the sheet transport mechanism (or the sheet) is arrested. This requires complex timing controls interlinking all the operations. Machines of this kind are described in our British patent specifications Nos. 1214639 and 2016377A.

In all instances of impact printing of high quality code lines of which we are aware, the sheet has been held stationary for the printing operation.

Apparatus embodying the present invention avoids the requirement for a stop to arrest the movement of the sheet to ensure that the printing is performed in registered condition, and also makes it unnecessary to ensure that the sheet is registered in relation to an operating cycle of the printing station before the sheet reaches that station Printing on a moving sheet is not new in itself. Conventional printing machines, using offset litho or letterpress, for example, print on a moving sheet or web. However, the printing plate is also moving in relationship with the sheet. Numbering machines may also employ a numbering box mounted in a chase, again moving in relation with the sheet. It has previously been considered that any attempt to print a code line using a stationary numbering unit with a continuously moving sheet would be unsatisfactory, in particular that the positioning of the code line on the sheet would not be sufficiently accurate.

By making advance registration of the sheet unnecessary, the invention removes the design constraint of synchronised track and printing station and the need for mechanical registration means. Furthermore, operation of the print wheels and other components of the printing station are triggered only when a sheet arrives at the station, so that wear on these components is reduced. In addition, the invention allows the track to be split into sections of different lengths, if desired, and allows different speeds for different operations, as the requirement for a timed relationship between the operations is removed; indeed, a portion of the track or the sheet may be stopped for some operations. Slight variation in speed between track sections will not lead to registration problems and the mechanical strain imposed by the continual stopping and starting of the track is also avoided. Unregistered and untimed sheets may be fed from a low-cost sheet feeder or directly from a printing machine, for example a litho printing machine which may be used to print the non-variable information.

In the preferred embodiment of the invention, the means responsive to the resulting signal from the detecting means includes a counter, the operation of which is initiated by the signal from the detecting means, and a circuit which initiates the performance of the printing operation on the sheet when the counter reaches a predetermined count, the apparatus further including a pulse generator supplying the counter with clock pulses at a rate corresponding to the speed of movement of the sheet along the flow path. This apparatus further checks the position of an existing mark, for example a part-printed code line. For this purpose, the detecting means provides a first signal in response to the detection of the edge of a sheet and a second signal responsive to the detection of an existing mark on the sheet, the first signal initiating counting in a second counter and the second signal being used to cause the contents of the second counter, representing the distance between the said edge and the mark, to be applied to comparator means for determining whether the said distance lies within a predetermined range.

The printing operation is carried out by means of a hammer driven against a spring by a cam and thereafter released to allow the spring to throw the hammer towards a print wheel, the apparatus further including a stop which is hit by the hammer when the hammer reaches the point of printing. The period of contact may be less than one millisecond and for this brief interval it appears that in the embodiment of the invention to be described there is a local stretching of the cheque paper in the contact area; it is to be understood that the statement that the sheet is fed continuously past the station includes such a case, which is to be distinguished from prior arrangements in which the sheet was stopped prior to the printing operation.

The detector may be responsive to electromagnetic radiation (for example, an infra-red detector) or a capacitive, ultrasonic or inductive detector; alternatively, where only the edge of the sheet need be sensed, the detector may be a microswitch or a simple reflective, or see-through detector. Such detectors are commercially available and their construction is well-known. The detector may be a simple photodell but may also be of the type employed for reading bar codes or O.C.R. characters. If desired, a further detector may be included so arranged that the sheet can be checked for skew, any resulting skew signal being used either to cause a further side lay operation or the rejection of the skewed sheet from the system.

In order that the invention may be better understood, an example of apparatus embodying the invention will now be described with reference to the accompanying drawings, in which.

Figure 1:
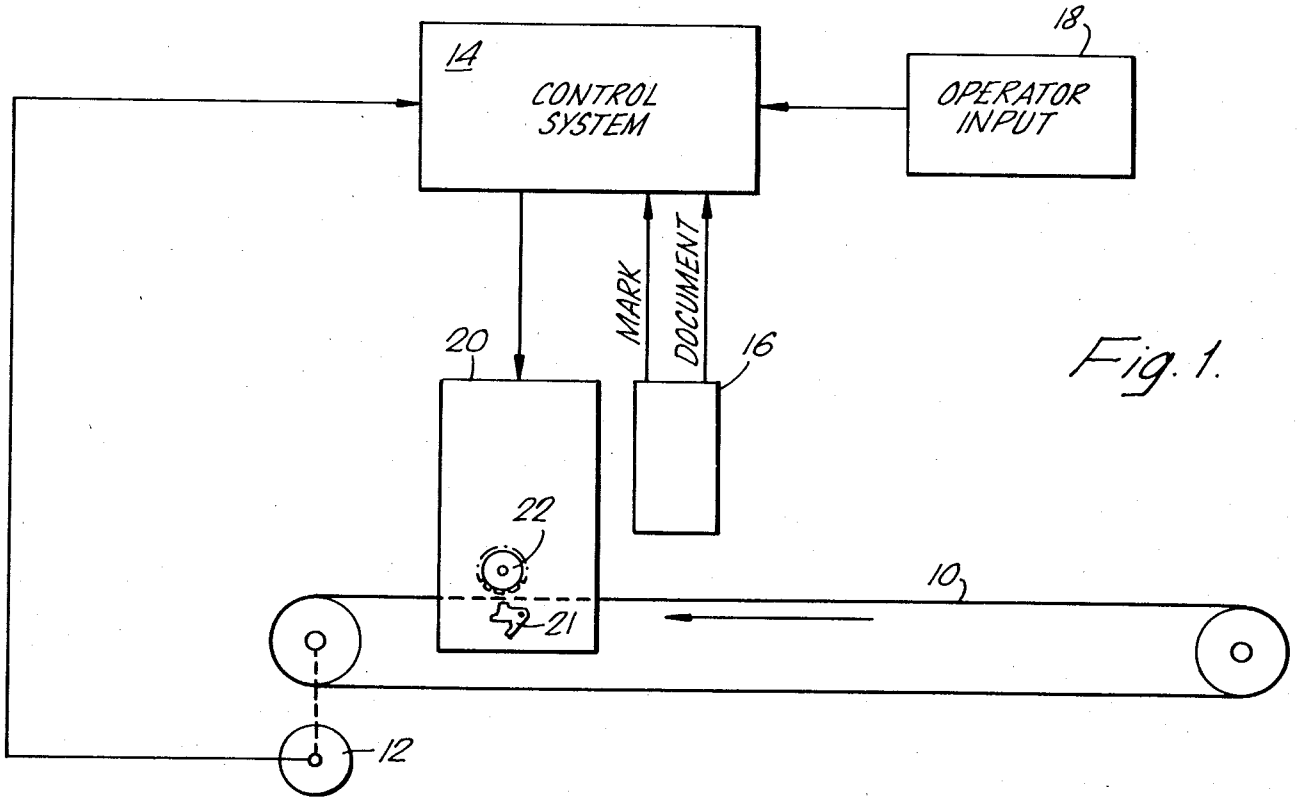
FIG. 1 is a block diagram illustrating the relationship of the components of the system.

In the arrangement of FIG. 1, sheets are fed from a printing machine or from a low-cost sheet feeder onto a paper transport system 10 to which is coupled an incremental shaft encoder 12. Pulses from the shaft encoder act as clock pulses for a control system 14. A detector 16 senses the leading edge of a sheet or a mark on the sheet (or both) and supplies the resulting signal to the control system 14. The system 14 also receives signals from an operator input device 18. The block 20 represents a printing device which, with the detector 16, constitutes the printing station. The signals provided by the operator input device may relate to the information which is to be printed as part of the code line by the device 20 or to the overall control of the system. The control system 14 also inherently contains or will receive from the operator input device 18 a preset number of shaft encoder pulses which depend on the relative position of the detector 16 and the device 20 for printing the code line on the sheet. The control system counts the pulses from the shaft encoder, beginning when the detector signal has been received, and when the count reaches a preset number the control system actuates the printing device 20 to fire a hammer 21 against a print wheel 22. The preset number is chosen to ensure that when printing takes place the sheet is in correct position for the printing operation.

In one arrangement, the shaft encoder is dispensed with and a signal corresponding to the detection of the leading edge of the sheet initiates the counting of a preset time interval in the control system 14, which then actuates the device 20. If the sheet requires a number of operations (for example a sheet of cheques), this process is repeated a given number of times per document; the preset times are all independent and variable, as is the repeat factor, these being entered from the operator's device 18.

In the preferred arrangement however the shaft encoder is used because it is cheap and easy to set up and ensures that any variation in track speed is immediately accounted for and registration will not suffer, assuming no slippage between paper and track, providing sufficiently high resolution is available from the shaft encoder. In practice a resolution of 0.0015 inch (0.038 mm) is sufficiently accurate. The preferred shaft encoder generates two sets of pulses, one being midway between the period of the other. The combination of these pulses increases the total resolution afforded by the shaft encoder and additionally indicates whether the track is moving forwards or backwards.

In one embodiment the invention is used in a computer controlled cheque printing and personalisation system. An offset litho printing machine is used to print some of the variable information on a cheque form such as, for example, the branch address, the branch's sort code, account name, and, optionally, a section of the magnetic ink character recognition code line (for example, the account number on which the cheque is to be drawn and the banks' branches' sort code). This machine is fed with cheque quality paper which has been preprinted with non-variable information such as, for example, a security grounding, a bank's name and the general cheque form design. The feeding and passage of sheets through the litho printing machine are controlled by the system's central micro-computer controller: incorrectly printed sheets are diverted out ot the system and extra sheets are printed to replace them. Sheets containing other information such as a cheque book re-order form, are fed through at appropriate places. The part-printed sheets are then fed to the code line printer essentially unregistered and untimed with respect to the codeline printing wheels.

Figure 2:
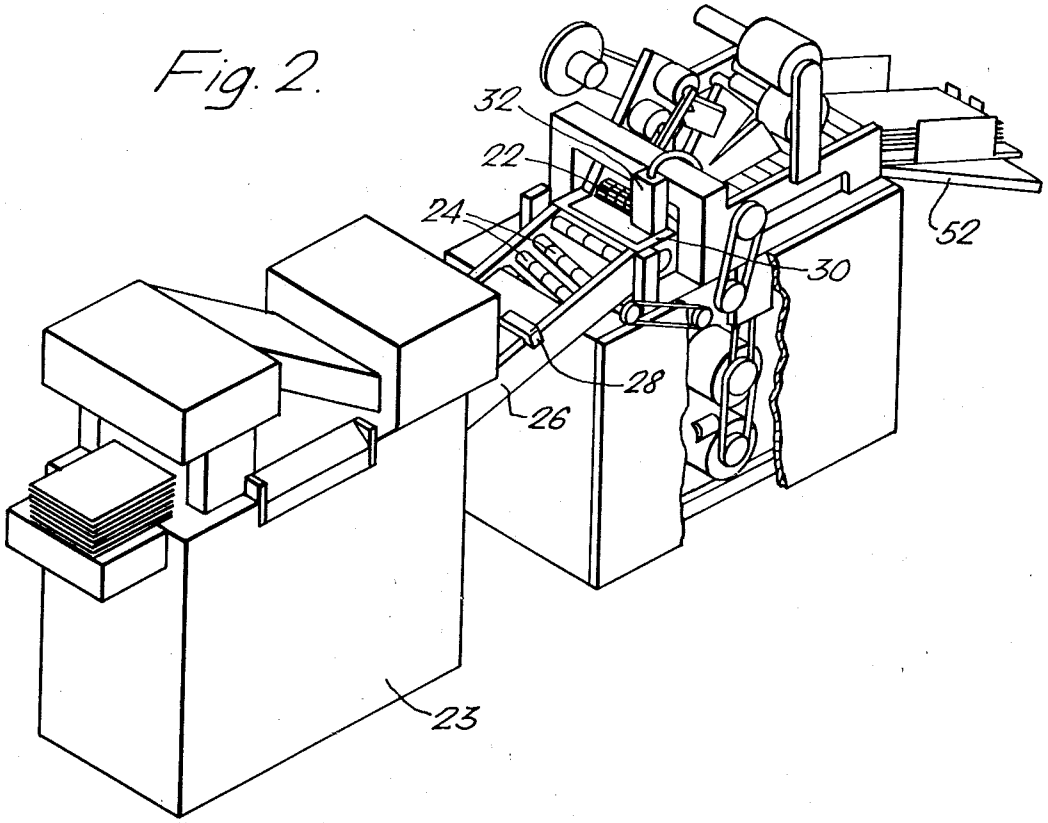
FIG. 2 is a perspective view of the apparatus as a whole, with parts broken away.
Figure 3:
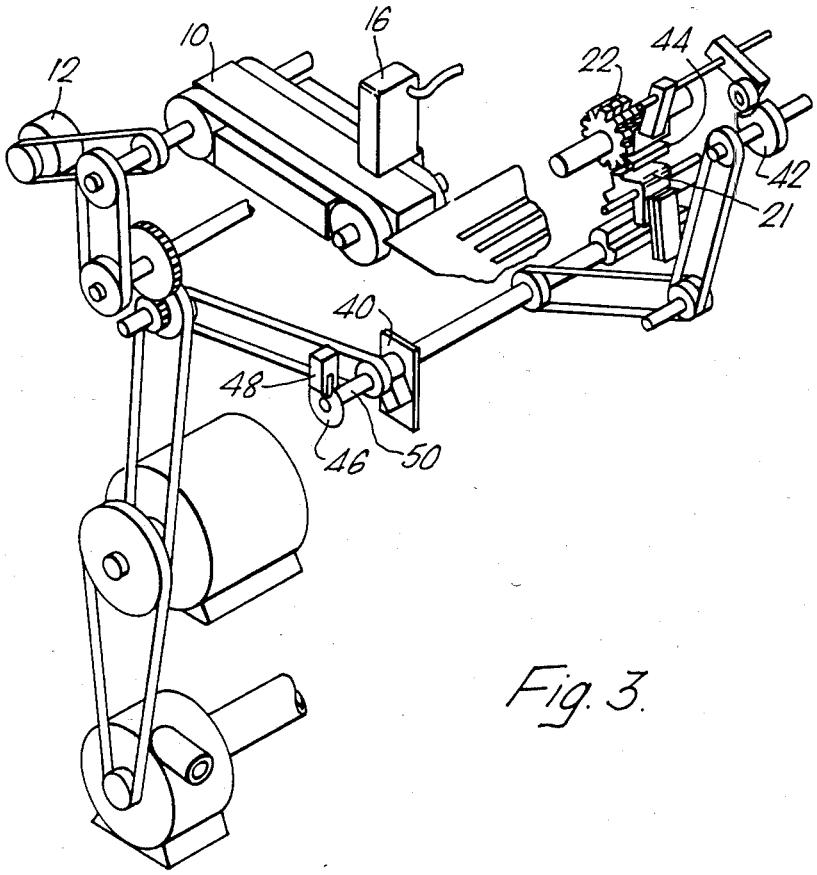
FIG. 3 is a perspective view of portions of the apparatus of FIG. 2 in greater detail.

FIGS. 2 and 3 illustrate apparatus for printing cheques including an offset litho machine 22 (FIG. 2) and a preferred embodiment of the invention for printing any of the following items of the code line which have not previously been printed in the litho machine, namely the sorting code for the bank branch, the account number, the optional transaction code, the serial number on the cheque and the serial number on the cheque stub.

In FIG. 2, sheets from the offset litho printing machine 23 are fed up a roller track, the rollers 24 of which urge each sheet against a bar 26 to register it for sidelay. In this example, a doubles detector 28 senses the presence of any superimposed sheets and provides a signal to cause the sheets to be rejected. This detector does not form part of the present invention and can be of any known kind. Each sheet is fed on to a vacuum track 30, without front registration, and its leading edge (or a mark or preprinted part of the code line on the sheet) is sensed by the detector 16. A second similar detector (not shown) may be provided, the signals from the two detectors enabling the sheet to be checked for skew.

A signal from the detector 16 initiates a count in control apparatus which will provide a signal for firing the printing hammers 21 (FIG. 3) under the print wheels 22. The pulses to be counted are provided by the shaft encoder 12 driven in synchronism with the movement of the vacuum track. The actuation of the printing hammer is effected through a single revolution clutch 40.

The single revolution clutch 40 also provides drive to cams 42 which insert aligner bars 44 into spaces between print faces in the printing wheels to align the print characters before the hammers are fired.

An arrangement of printing wheels, setting mechanism for the printing wheels and aligner bar, suitable for use in the present apparatus, is more fully described and illustrated in our British patent specification No. 2018684B.

The printing process may be repeated a number of times per document and the print wheels can be reset between each printing operation. Different counts in the control apparatus may be required for each printing operation on the sheet and these are entered into the controller by the operator, or are called from a memory, before the printing operation starts.

As a check that printing has occurred, a first detector comprises a disc 46 which is opaque except for one clear window in a radial section and a light detector 48 which, when the disc revolves on hammer drive shaft 50, provides on and off signals. As the hammer fires, a signal from the light detector 48 is sent to the controller to instruct it to check the status of the aligner bar 44. A further detector (not shown) then checks that the aligner bar 44 has entered slots in the print wheels to align them and thereby to provide the required standard of print alignment on the document. If the aligner bar has not operated correctly, i.e. has not entered aligned slots in all printing wheels, it is assumed that the printing wheels are not aligned and the sheet is rejected. The rejection signal from the controller causes a diverter mechanism of known kind to be actuated, as a consequence of which the sheet is deflected into a waste hopper 52 (FIG. 2). The use of an aligner bar and a detector for the aligner bar are disclosed in the abovementioned British patent specification No. 2018684A.

In the embodiment which is being described, the single detector 16 is used to detect first the leading edge of the sheet and then the position and orientation of the first part-code line and, optionally, to read part or all of that code line and to check that the code line is in the correct position relative to the leading edge of the sheet and that at least one of the characters of the code line is correct. Detectors may thereafter be used to check that all subsequent code lines which may be printed on that sheet are in the correct position with respect to the leading edge of that sheet and with respect to all previously printed code lines The detector and hammer control system will now be described with reference to FIG. 4. As stated above, the sheet leading edge is detected by the detector 16, which is a part of the detection circuit 60 in FIG. 4. In the absence of a sheet under the detector, the circuit 60 generates a high logic level signal and while the high level signal exists a counter 62 continuously resets itself. When a sheet is detected, the detection circuit 60 generates a logic low-level signal DOCUMENT which remains active for the period that the sheet is beneath the detector (see FIG. 5). The DOCUMENT signal clears the "reset" terminal on the incrementing 16-bit counter 62, hence enabling the counter. A second logic low-level signal TEXT is generated when the detector 60 senses a transition between the white background and the black print of the first (and then subsequent) code lines, as shown in the waveform of FIG. 5. This signal acts to cause the interrupt controller 64 to apply an interrupt signal to a microcomputer controller 66.

The shaft encoder 12 generates signals in quadrature on its two output channels and these are applied through an interface circuit 68 to the counter 62 and to a second counter 70. A suitable shaft encoder is made by Litton Precision Products, a division of Litton International Incorporated. The first counter 62 is connected so as to increment when the shaft encoder revolves in the forward direction and to decrement when the shaft encoder revolves in the reverse direction. The second counter 70 is connected to decrement and increment when the shaft encoder revolves in the forward and reverse direction respectively but pulses have no effect on counter 70 until it receives a LOAD ENABLE signal in the absence of which the counter is cleared continuously. The provision of quadrature-phase output from the shaft encoder enables the direction of rotation, as well as the incremental position of the shaft encoder, to be resolved. As the shaft encoder is coupled to the track drive responsible for transporting the sheet, the count of pulses from the shaft encoder tracks the movement of the sheet from the time its front edge is detected. The channel for the reverse signal is provided to allow for the effects of shock and vibration on the system.

Figure 6:
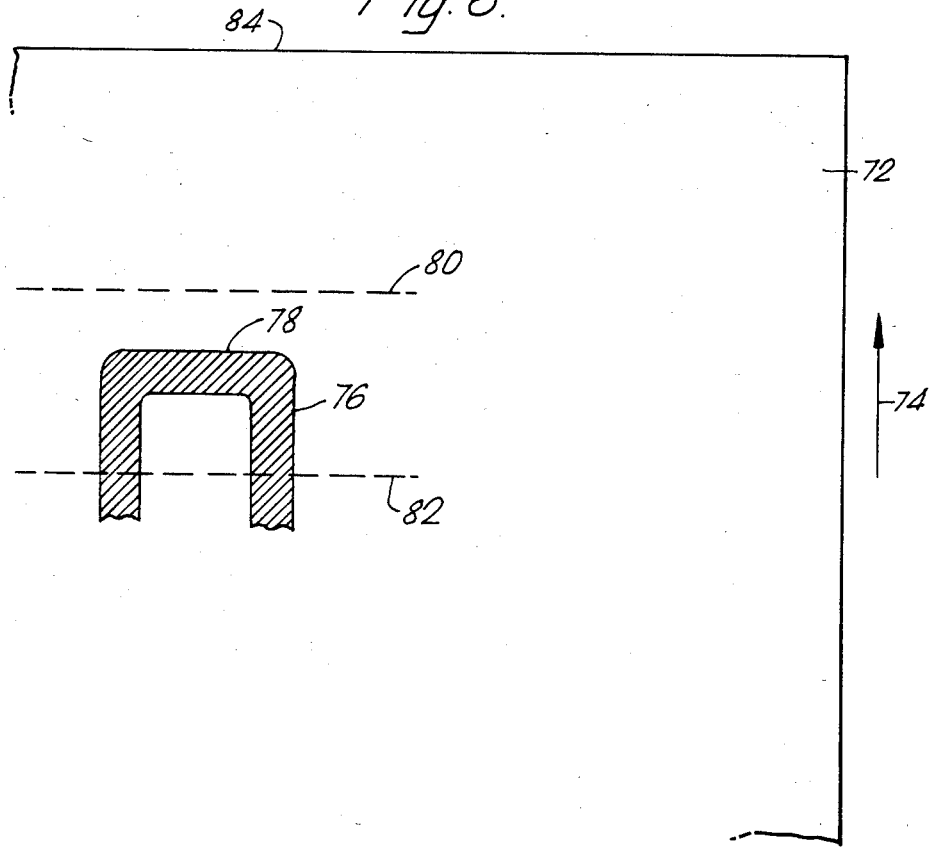
FIG. 6 shows a sheet with a mark upon it and with additional lines indicating the operation of the apparatus embodying the invention.

Once the TEXT signal has been generated, the validity of the positioning of the first part-printed code line with respect to the leading edge of the sheet must first be established. The microcomputer controller stores upper and lower limits between which the position of the first code line is valid, as illustrated in FIG. 6. In FIG. 6, a sheet 72, travelling in the direction of arrow 74, contains a part-printed code line 76, greatly magnified in the drawing; the leading edge 78 of this code line must appear to the controller to be within the "window" represented by the limits and indicated by the dotted lines 80 and 82, the position of these dotted lines or limits being established with respect to the leading edge 84 of the sheet.

The manner in which the "validation" of the position of the code line is carried out will now be described.

Following the generation of the "interrupt" signal in response to the sensing of the code line from the signal TEXT, a READ ENABLE signal, generated by the micro computer, is applied through a first input/output port 86 to a 16-bit latch 88 to allow the value of the count in the counter 62 to be latched into the latch circuit 88. The 16-bit data word is then transferred to the port 86 in two bytes, through the 8-to-4 bit multiplexers 90 and 92; these are controlled by a READ HI/LO signal so as to transfer in turn a low-order byte and a high-order byte. The data word is fed to the microcomputer 66 which determines whether the text is in the correct position, first with respect to the leading edge of the sheet and subsequently with respect to a previous code line. If it is not, a "reject" signal is generated.

If the code line position is within the predetermined limits, counter 70 is loaded with the value of the incremental distance, in terms of the number of pulses from the shaft encoder, between the text detector and the hammer. This value is loaded from the microcomputer 66 through a second input/output port 94 as two 8-bit bytes and is routed to the counter 70 by way of data selectors 96 and 98, all under the control of a LOAD ENABLE signal applied to the counter 70, and LOAD LO and LOAD HI signals applied to the data selectors 98 and 96. Circuits 90, 92, 96 and 98 are required only because a 16-bit counting is needed but only 8-bit control systems are used in this apparatus. As soon as the LOAD ENABLE signal is removed by the microcomputer, the counter 70 begins to count down in response to the pulses from the shaft encoder interface 68. When this second counter 70 has decremented to zero, an interrupt signal is sent to the microcomputer 66 by way of the control circuit 64. The microcomputer then generates, substantially instantaneously, a CALL HAMMER signal which is transmitted through the input/output port 86 to trigger an adjustable delay circuit 100. The delay circuit activates a timer circuit 102 which generates a pulse to fire the single revolution clutch mechanism 40, thereby activating the printing hammer which strikes the print ribbon and sheet against the print wheels. The delay circuit 100 enables adjustments to be made to suit the characteristics of the single-revolution clutch. Printing takes place at the instant that the part pre-printed code line is in the correct position.

A similar procedure is followed to fire the hammers for each print position on a sheet to ensure that each code line is printed in the correct position with respect to the previous code line.

Figure 4:
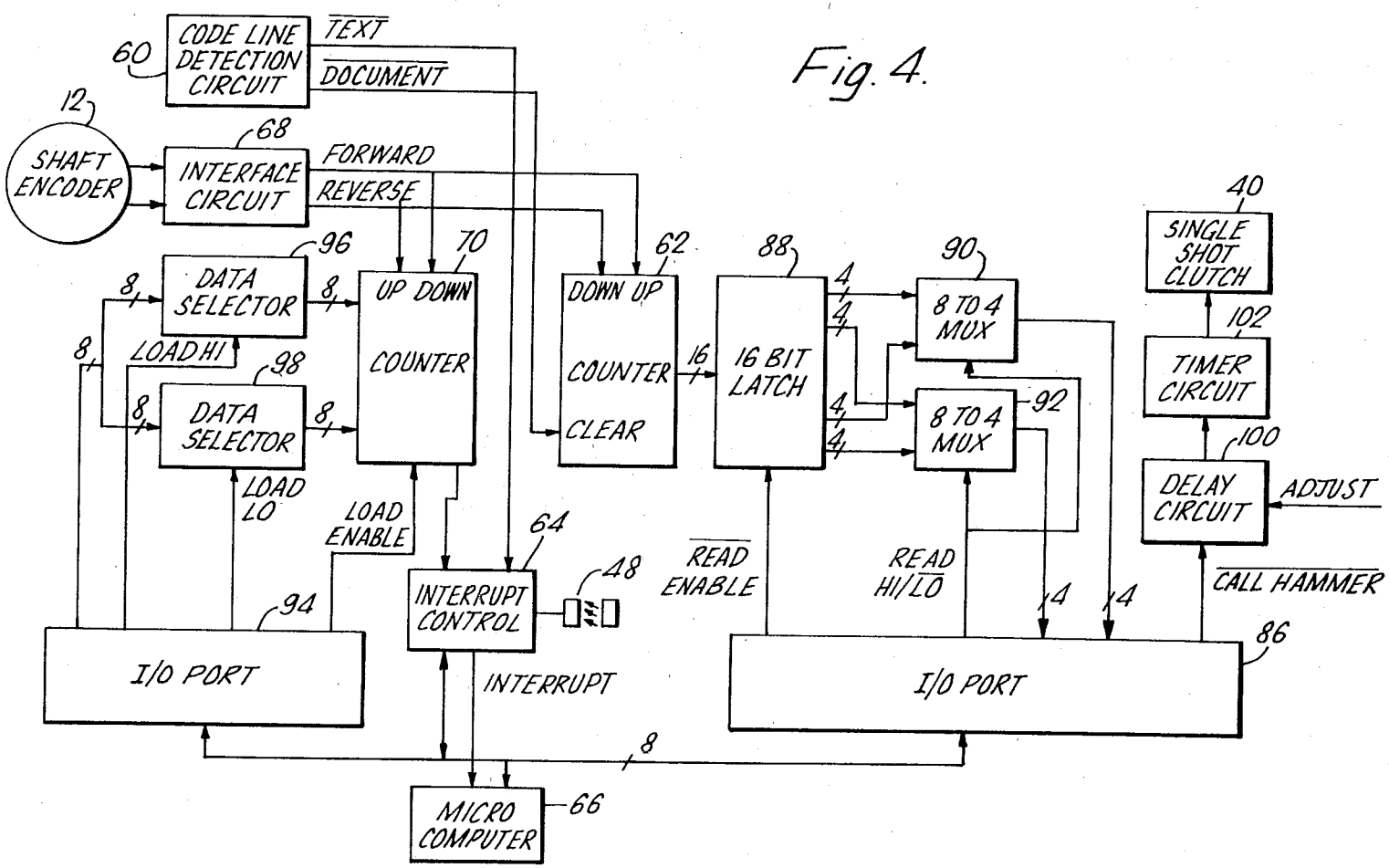
FIG. 4 is a block circuit diagram of controller apparatus embodied in the machine of FIG. 2.
Figure 5:
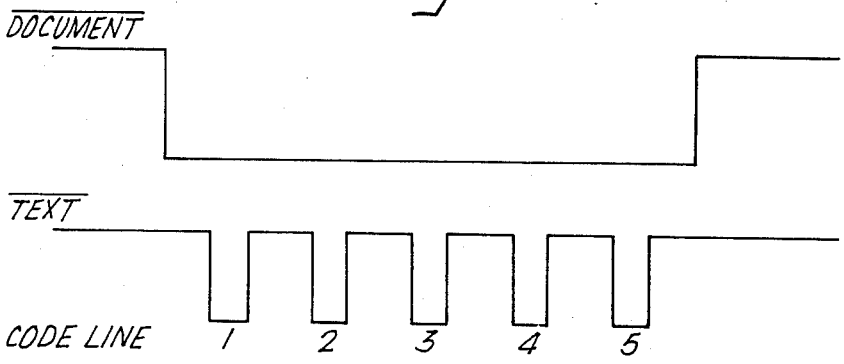
FIG. 5 is a waveform diagram relevant to components in FIG. 4.

FIG. 4 also shows the detector 48, previously described, connected to the "interrupt control" circuit 64, for initiating the print quality check.

Figure 7:
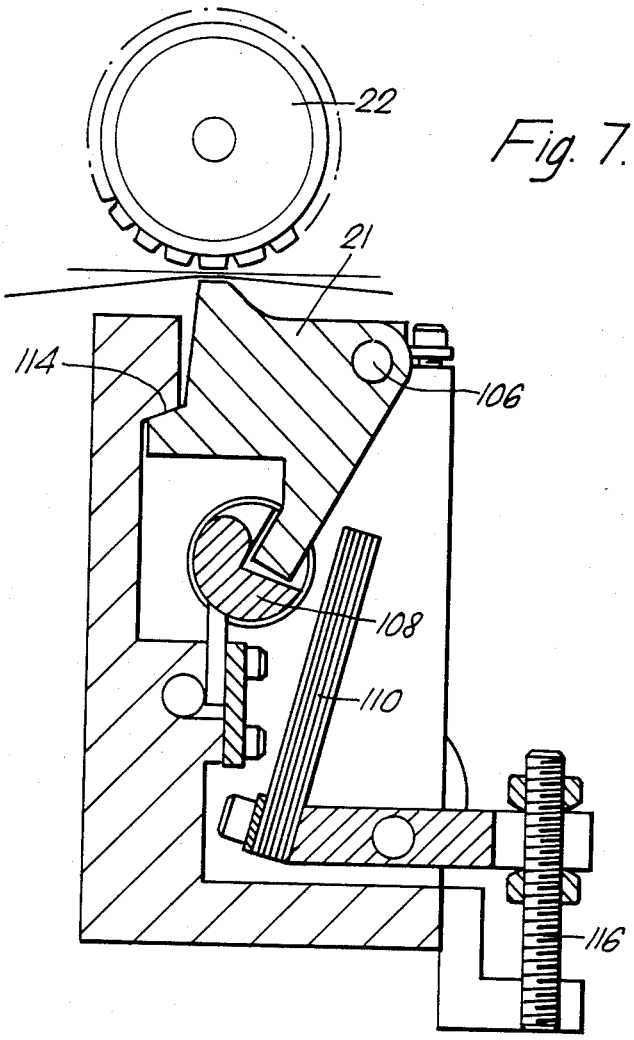
FIG. 7 shows the printing hammer mechanism of the machine of FIG. 2 in greater detail.

FIG. 7 illustrates the hammer unit in greater detail and in cross section. In FIG. 7, the hammer 21, pivoted at 106, is just beginning to descend from its print stroke. Cam 108 which rotates clockwise in FIG. 7, urges the hammer 106 against a leaf spring 110. As the cam 108 releases the hammer, the leaf spring throws the hammer towards the print wheels 22. At the point of printing, the hammer hits a stop 114 which is of comparatively large mass, as a result of which a very fast change in direction occurs, thereby achieving a very short printing time. In one typical arrangement, the print hammer maintains contact between the sheet, the printing ink ribbon and the print wheels for less than one millisecond, during which period local stretching of the cheque material may occur. This stretching is believed to be of the order of 0.025 mm and occurs during a printing hammer dwell time of about 50 microseconds. After the change in direction, the hammer returns to its rest position and is prevented from bouncing back to the print position (which would cause double striking) by the cam profile. When a succession of sheets are fed through for printing, as soon as the single revolution clutch is fired, the cam begins urging the hammer against the spring to start the next print cycle. The rest position is such that the hammer is almost on the point of being released by the cam against the fully tensioned spring, such that when the printing signal is generated, printing is almost instantaneous.

The leaf spring 110 may be adjusted for position, and hence for spring pressure, by means of an adjustable device 116; this allows the spring to be moved forwards towards and backwards from the centre of the cam. Through in the preferred embodiment, the hammer cam is driven by a continuously revolving motor, through the single revolution clutch, it may also be driven by a stepping motor or a servo motor.

The embodiment described is specifically suited for cheques and like documents; however, the invention could as easily be used for other documents which require selected lines of characters to be printed at high speeds; examples of such documents are bank stationary, including bank giro credits and travellers cheques, and also lottery tickets and many types of payment documents, all of which are referred to in this specification as "sheets".

To allow for sheets of different lengths or changes in the position of the print on the sheet, the positions of the detectors in relation to the printing hammers may be changed or the intervals between the detection of an edge or mark and the operation of the printing hammer may be changed. These intervals may be adjusted preferably through the microcomputer, or by other means such as thumb-wheel switches.

In the above description, a shaft encoder and timing circuit are proposed for controlling the timing of the printing operation once the edge of a sheet or a mark or other feature on the sheet has been detected. This is the preferred arrangement but it is also possible in some cases to utilise a series of detectors downstream of the printing head, each detector triggering a printing operation immediately it senses its sheet edge or other feature, the detectors being positioned at distances downstream of the printing head such as to ensure that the printing operations are in correct register with the edge or feature of the sheet. However, with such an arrangement a change in the arrangement of cheques on a sheet or in the position of code lines within a sheet or cheque, or the size of the sheet, requires the array of detectors to be accurately repositioned.

Also, in the embodiment described we have proposed a single-revolution clutch to control the movement of the hammer. More precise control of the hammer firing time can be obtained utilising a stepping motor. Thus, in FIG. 3, the single revolution clutch and its belt drive are omitted and the stepping motor is placed on the end of the shaft previously driven through the single revolution clutch. The detector 48 can then be transferred to the other end of the shaft.

Figure 8:
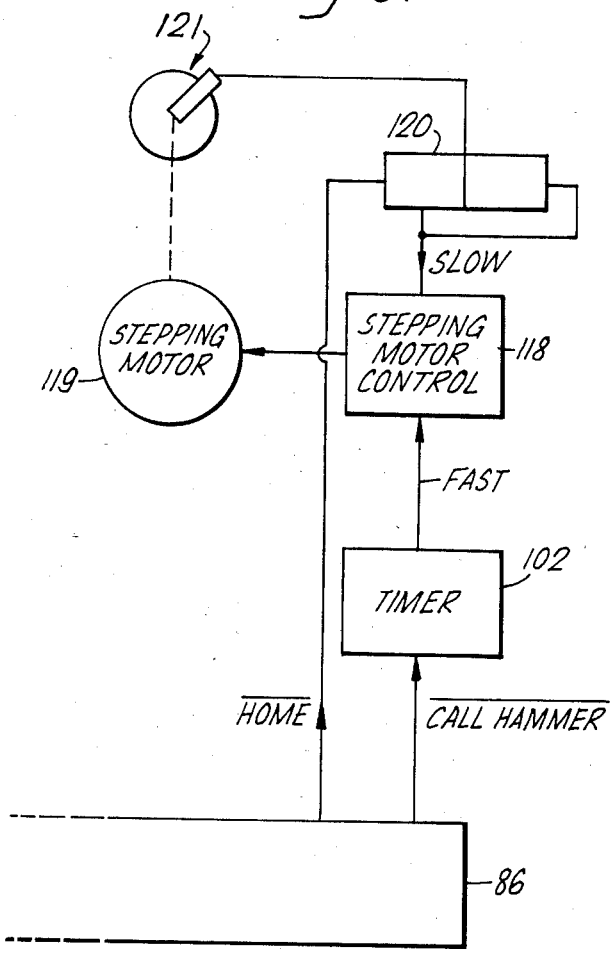
FIG. 8 shows a modification of a part of the block circuit diagram of FIG. 4, for use when a stepping motor is employed to drive the printing hammer shaft.

FIG. 8 shows the modification to the block circuit diagram of FIG. 4 which is required when the stepping motor is employed.

Before each print run, the stepping motor must drive the hammer cam to its "home" position, i.e. the point at which the hammer spring is fully tensioned; thereafter, a very small increment of cam rotation will cause the hammer to fire. In FIG. 8, a stepping motor 119 is used in a show-pulse mode when the apparatus is initially set up. The show pulses are derived from unit 86 by way of $\overline{\text{HOME}}$ line; this is connected to a D-type flip-flop 120

(FM7474) by means of which the slow pulses are relayed to a stepping motor control circuit 118 and thence to the stepping motor. When a third detector 121 senses that the hammer has reached its "home" position, a signal from the detector 121 to the flip flop stops the application of slow pulses to the stepping motor. The detector 121 may be a see-through detector looking for a black/white transition on a disc attached to the shaft of the stepping motor. When the call hammer signal is generated to initiate a printing operation, the stepping motor moves rapidly from the "home" position under the control of the fast pulses, to cause the hammer to fire and continues on to its "home" position again.

It will be realised that if only the edge of a document, or only a mark on the document, is to be detected, then the document signal from circuit 60 of FIG. 4 is sent directly to the "interrupt control" circuit 64, thereby initiating the counting sequence to fire the hammer directly.

It has been stated that the counter 70 (FIG. 4) is loaded with the value of the distance between the text detector and the hammer. In general terms, the counter is loaded with a value dependent on both the distance between the detector and the point along the flow path at which the sheet is printed and the distance on the sheet between the edge or feature detected and the position at which the print is to appear. In the special case in which a print line is detected and the new print is to be aligned with the existing print in this line, the second distance is zero (as in FIG. 4).

We claim:

1. Apparatus for printing a line of characters in a desired print line location on each of a series of sheets so that the resulting printed line of each sheet is registered with respect to a feature of the sheet, comprising:

means defining a flow path for the sheets;

a printing station located at a predetermined point along the flow path and comprising impact printing means including individually rotatably adjustable print wheels mounted on a common shaft, the axis of which is transverse and fixed with respect to said flow path, each print wheel having a plurality of character faces spaced around its periphery and individually selectable by rotation of each wheel about the said axis to predetermined print positions, the said axis extending in a direction parallel to the required line of characters on the sheet passing through the apparatus, and a hammer to cause impact printing of a sheet against a type face whereby the print wheels together print a line of characters, one for each wheel, in a single operation, each character printed being determined by the respective rotated position of the corresponding print wheel;

means for locking the print wheels in the positions to which they have been rotated;

sheet feeding means for feeding a succession of sheets the spacing between which may vary, continuously and at a substantially constant speed along the flow path and through the printing station, sensing means detecting the arrival of the said feature of the sheet at a given point along the flow path and providing a corresponding electric signal; and printing control means responsive to said signal from said sensing means and to the speed of travel of the sheet to initiate printing hammer firing when the desired print line location on the sheet reaches the printing station, whereby regardless of the speed of travel of, intervals between the individual sheets, or time of arrival of the sheets at the printing station, printing of a line of characters is effected by the stationary print wheels in register with respect to the said feature of the sheet without substantially changing the speed of the sheets.

2. Apparatus in accordance with claim 1, comprising a spring for the printing hammer, a cam for driving the hammer against the spring and which maintains the hammer against the spring until printing is initiated, and means for driving the cam to its hammer release position, allowing the spring to throw the hammer towards the print wheels;

the apparatus further including a stop which is hit by the hammer when the hammer reaches the point of printing.

3. Apparatus in accordance with claim 1, in which the printing control means includes:

a first counter, the operation of which is initiated by the signal from the detection means;

a circuit which initiates printer hammer firing when the counter reaches a predetermined count; and a pulse generator supplying the counter with clock pulses at a rate corresponding to the speed of movement of the sheet along the flow path.

4. Apparatus in accordance with claim 3, in which the detecting means provides a first signal in response to the detection of the edge of a sheet and a second signal responsive to the detection of an existing mark on the sheet, the apparatus comprising:

a second counter connected to receive the first and second signals; and a comparator;

the first signal initiating counting in the second counter and the second signal applying the contents of the second counter, representing the distance between the said edge and the existing mark, to the comparator means to determine whether the said distance lies within a predetermined range; and wherein the second signal additionally initiates counting in the first counter.

5. Apparatus in accordance with claim 3 or 4, including:

means for preloading the first counter with a value dependent on both the distance between the detector and the point along the flow path at which the printing operation takes place, and the distance on the sheet between the feature detected and the printing line location on the sheet; and in which the first counter counts clock pulses, starting from the sensing of the said feature by the detecting means, and initiates printing hammer firing when the count reaches the preloaded value.

6. Apparatus in accordance with claim 3, in which the pulse generator includes a shaft encoder coupled to a shaft for driving a belt on which the sheet is advanced along the flow line to the printing station, for providing the said clock pulses.

* * * * *